US010047461B2

(12) United States Patent
Aurich et al.

(10) Patent No.: US 10,047,461 B2
(45) Date of Patent: Aug. 14, 2018

(54) CONTEXTURE FOR ATTACHING WIRING AND GRINDING DISCS

(71) Applicant: Gebrueder Aurich GmbH, Radevormwald (DE)

(72) Inventors: Matthias Aurich, Radevormwald (DE); Wolfgang Aurich, Radevormwald (DE)

(73) Assignee: GEBRUEDER AURICH GMBH, Radevormwald (DE)

( * ) Notice: Subject to any disclaimer, the term of this patent is extended or adjusted under 35 U.S.C. 154(b) by 779 days.

(21) Appl. No.: 14/246,081

(22) Filed: Apr. 5, 2014

(65) Prior Publication Data

US 2014/0311188 A1 Oct. 23, 2014

(30) Foreign Application Priority Data

Apr. 9, 2013 (DE) ..... 10 2013 006 008
Apr. 17, 2013 (DE) ..... 10 2013 006 612

(51) Int. Cl.
*D04B 21/10* (2006.01)
*D04B 21/02* (2006.01)

(52) U.S. Cl.
CPC ..... *D04B 21/02* (2013.01); *D10B 2403/01* (2013.01)

(58) Field of Classification Search
CPC ..... D04B 21/02; D04B 21/04; B24D 9/085; B24B 45/006
USPC ..... 66/192–194
See application file for complete search history.

(56) References Cited

U.S. PATENT DOCUMENTS 4,338,800 A * 7/1982 Matsuda ..... A44B 18/0042 28/161
4,467,625 A * 8/1984 Kurz ..... D04B 21/02 66/190
4,624,116 A * 11/1986 Rogers ..... A44B 18/0034 24/445
4,677,011 A * 6/1987 Matsuda ..... A44B 18/0034 428/100
4,709,562 A * 12/1987 Matsuda ..... A44B 18/0034 24/445
4,838,044 A * 6/1989 Matsuda ..... A44B 18/0034 66/190

(Continued)

FOREIGN PATENT DOCUMENTS

DE 29618285 4/1997
EP 1066670 B1 7/2004

(Continued)

*Primary Examiner* — Danny Worrell
(74) *Attorney, Agent, or Firm* — Von Rohrscheidt Patents

(57) ABSTRACT

The invention relates to a warp knitted contexture including a base structure and pile loops anchored in the base structure for rattle free attachment of wiring harnesses or for attachment of replaceable grinding discs at grinding machines. It is an object of the invention to provide a new warp knitted contexture for both applications recited supra and other applications, wherein the warp knitted contexture can be produced in a more economical manner and has constant quality or a constant surface. The object is achieved in that a plurality of independently standing pile loops is arranged at the base structure through unilaterally tied drop stitch, wherein a height of the pile loops is greater than a distance between stitch wales and the pile loops are only arranged on the technically left side of the product.

19 Claims, 2 Drawing Sheets

(56) References Cited

U.S. PATENT DOCUMENTS 5,065,600 A * 11/1991 Byles ..... A61F 13/15577 66/193
5,297,366 A * 3/1994 Huddleston ..... B24D 9/085 451/525
5,692,949 A * 12/1997 Sheffield ..... A44B 18/0011 428/94
5,789,058 A * 8/1998 Usher ..... B32B 3/06 428/100
6,024,634 A * 2/2000 Hoglund ..... B24D 11/005 451/526
6,096,667 A * 8/2000 Rhode ..... A44B 18/0034 24/444
6,216,496 B1 * 4/2001 Gehring ..... A44B 18/0034 66/191
6,234,886 B1 * 5/2001 Rivard ..... A47L 11/164 451/353
6,394,887 B1 * 5/2002 Edinger ..... B24B 23/02 451/490
6,845,639 B1 * 1/2005 Hajek ..... A44B 18/0034 66/195
6,988,941 B2 * 1/2006 Saunier ..... B24D 9/085 451/490
7,207,195 B2 * 4/2007 Okawa ..... A44B 18/0023 66/193
8,713,974 B2 * 5/2014 Tsuchida ..... D04B 21/02 66/194
2004/0099019 A1 5/2004 Sasser et al.
2014/0311188 A1 * 10/2014 Aurich ..... D04B 21/02 66/194

FOREIGN PATENT DOCUMENTS

EP 1817972 A2 8/2007
FR 2688164 3/1992
GB 2390560 A 1/2004
JP 2005253667 9/2005

* cited by examiner

CONTEXTURE FOR ATTACHING WIRING AND GRINDING DISCS

RELATED APPLICATIONS

This application claims priority from German patent applications DE 10 2013 006 008.7 filed on Apr. 9, 2013 and DE 10 2013 006 612.3 filed on Apr. 17, 2013, both of which are incorporated in their entirety by this reference.

FIELD OF THE INVENTION

The invention relates to a warp knitted contexture with a base structure and pile loops anchored therein.

BACKGROUND OF THE INVENTION

A warp knitted material of this general type is known from non patent literature relating to rattle free attachment of wiring harnesses in motor vehicles and on the other hand side in the context of attaching replaceable grinding discs at grinding machines.

The warp knitted material known in the art and also produced by applicant does not have the desired technical properties immediately after production and therefore has to be treated in several complex steps. In particular this warp knitted material is configured very flat and can thus not be used for rattle protection. Additionally it is not suited as a textile side of a hook and loop closure arrangement.

In view of this fact the known warp knitted contexture is initially washed in a first step which removes the oils adhering to the warp knitted material. Thereafter it is dyed and provided in a next step to so called velourization which provides roughening. Thus, the structure of the warp knitted material is highly loaded and compressed wherein a width of the material, in particular when producing the velour for rattle protection is significantly reduced by up to 50%. During velourization a surface of the warp knitted material also becomes uneven.

Eventually the product has to be fixated in a final step which is performed through heating and in a very last step the back side of the product is provided with a glue layer.

As a matter of principle also the warp knitted material which is used for attaching grinding discs is produced in the same manner wherein, however, yarns with a significantly lower dtex and thus also with lower surface weight are being used.

BRIEF SUMMARY OF THE INVENTION

Thus, it is an object of the invention to provide a new warp knitted contexture for the two applications recited supra and other applications wherein the warp knitted contexture can be produced in a more cost effective manner and also has a constant quality or surface structure.

The object is achieved with the features of claim 1, in particular the features in the body of the claim wherein a plurality of independently standing pile loops is arranged on a base structure through unilaterally tied drop stitch, wherein a height of the pile loops is greater than a distance between stitch wales and the pile loops are only arranged on the technically left side of the product.

The solution according to the invention has in particular the great advantage that the contexture after being produced on the knitting machine can be directly provided with a glue layer without additional costly process steps and can then be provided for the intended application.

The warp knitted material according to the invention does not only have sufficient stability through the warp knitted base structure but also includes a pile loop configuration which guarantees without any velourization right from the start that the pile loops extend from the base structure essentially at a right angle so that the connected warp knitted material contrary to the prior art is not flat but has a great "depth" which on the one hand side advantageously facilitates applications for rattle protection and on the other hand side the pile loops advantageously provide attachment points for the hook side of a hook and loop closure in this position.

It has also become apparent that the warp knitted material according to the invention is very advantageous for applications in which the side of the warp knitted material including pile loops shall be encased through foaming or injection molding since the pile loops due to the configuration of the contexture according to the invention are substantially arranged at a right angle relative to the base structure.

In one embodiment of the invention the base structure of the warp knitted material is formed from non elastic yarn and/or includes a non elastic layup.

In an advantageous embodiment the warp knitted material has 14-40 stitch courses per centimeter and between 5.5 and 8.6 stitch wales per centimeter which achieves a good depth (fluffiness) relative to the amount of material used and also a good positioning of the pile loops. A particularly advantageous warp knitted material, however, includes up to 30 stitch courses per centimeter and 7 stitch wales per centimeter as found in tests by applicant.

Another embodiment of the invention is characterized in that the warp knitted material is formed from a multi filament yarn which yields advantages when further processing and handling finished products due to improved flexibility.

In another advantageous embodiment the warp knitted material includes a yarn with a dtex of 50 to 100 for applications providing rattle protection, wherein a yarn with a dtex of 76 is advantageously used.

Also in a context with an application for attaching grinding discs an embodiment of the warp knitted material includes yarns with a dtex between 40 and 67, wherein a dtex of 50 is advantageously provided.

As a function of the application it is apparent that as a matter of principle yarns with a lower dtex are used for attaching grinding discs than for an application as a rattle protection since a warp knitted material with a lower area weight suffices for attaching grinding discs, however this lower weight warp knitted material has to include a sufficient number of "standing" pile loops.

An advantageous embodiment of the invention includes for all applications pile loops that have been produced with a stitch of 10-34. Thus, the nitted material advantageously includes large pile loops on the one hand side which are on the other hand side reliably arranged in an upright position.

Eventually also using the warp knitted contexture for stabilizing a surface of a foam rubber element and/or for generating a surface for receiving a glue layer or for providing a textile surface of a foam rubber element and/or for providing a surface for receiving a glue layer is claimed wherein the warp knitted material according to the invention can be used for a plurality of additional applications.

BRIEF DESCRIPTION OF THE DRAWINGS

Additional advantages of the invention can be derived from the subsequent description of an embodiment with reference to drawing Figures, wherein.

DETAILED DESCRIPTION OF THE INVENTION

Figure 1:
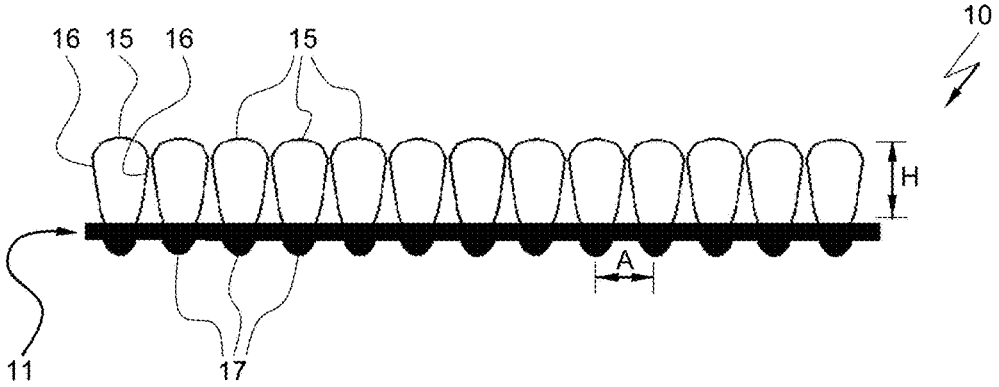
FIG. 1. illustrates a highly enlarged schematic sectional view of the warp knitted contexture.

In the drawing figures a warp knitted material for rattle free attachment of cable harnesses or for attachment of replaceable grinding discs for grinding machines is overall designated with the reference numeral 10.

Figure 2:
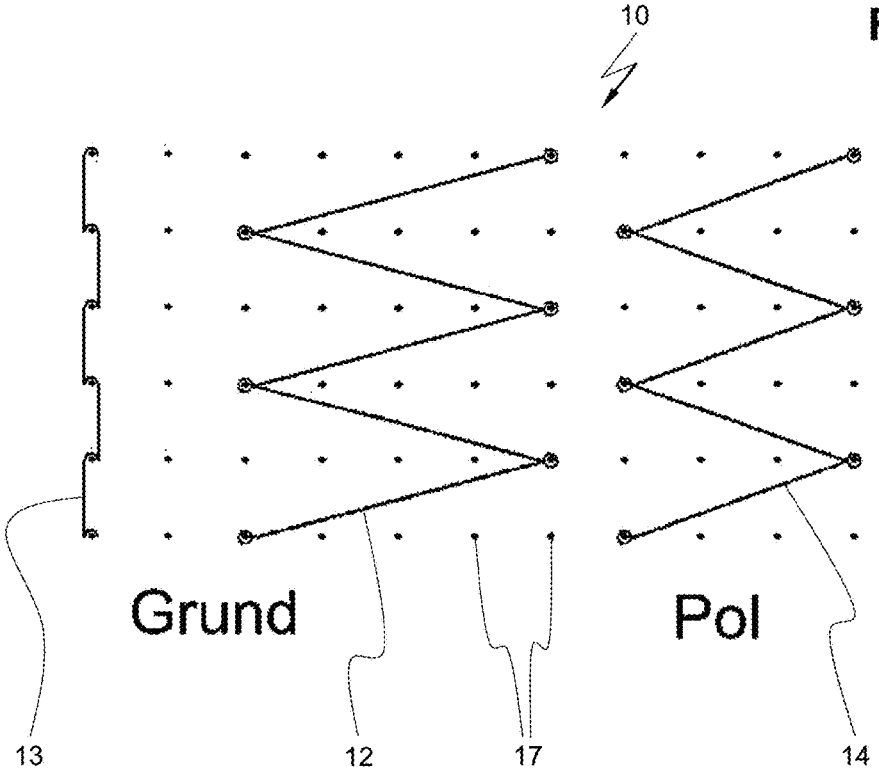
FIG. 2 illustrates a stitch of the warp knitted material according to FIG. 1.

In a schematic sectional view according to FIG. 1 the warp knitted contexture 10 is illustrated greatly enlarged. The warp knitted material 10 has a base structure 11 which is formed in a manner that is not illustrated in FIG. 1 from a base thread 12 and a tassle thread 13 (c.f. FIG. 2). Pile threads 14 are meshed with the base structure so that both arms 16 of the pile loops 15 are arranged on the same stitch wales 17.

Furthermore the fact that according to FIG. 1 the height H (1.5-2 mm) of the pile loops 15 is greater than the distance A (1.41 mm) between the stitch wales 17 according to which it is provided for the warp knitted contexture 10 that the pile loops 15 are arranged upright adjacent to one another. This has the effect that the warp knitted contexture 10 does not only have great "fluffiness" (good rattle protection) but also pile loops 15 that are easily captured by a hook element of a hook and loop closure.

FIG. 2 illustrates the stitch pattern of the warp knitted contexture 10 described supra. On the left side there is the tassle thread 13 which forms the base structure 11 with the base thread 12, wherein the pile thread 14 is illustrated on the right side, wherein the pile thread is only meshed with a stitch wale 17 through unilaterally tied drop stitch.

Figure 3:
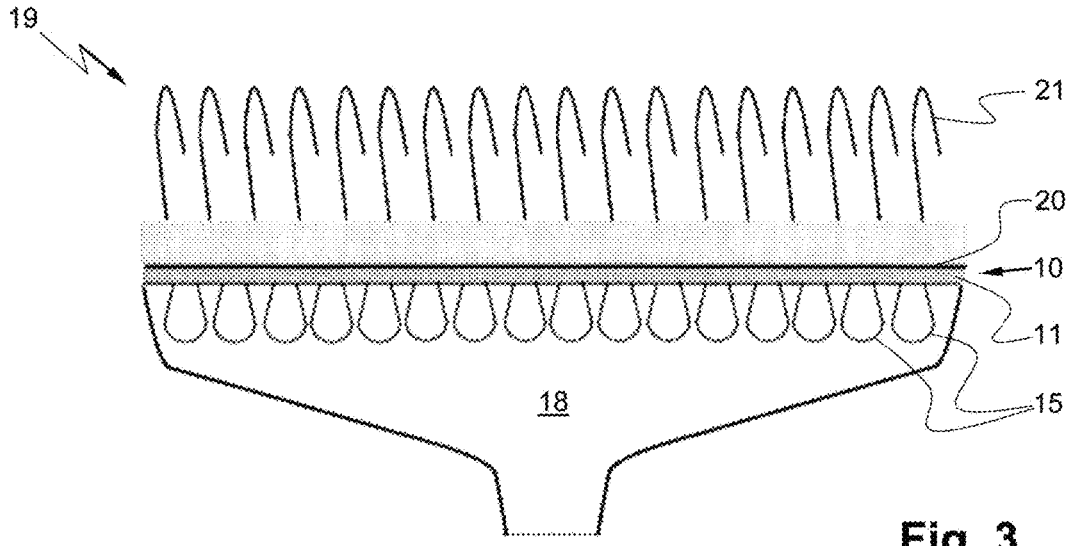
FIG. 3 illustrates a rotating element made from foam rubber for a grinding machine.
Figure 4:
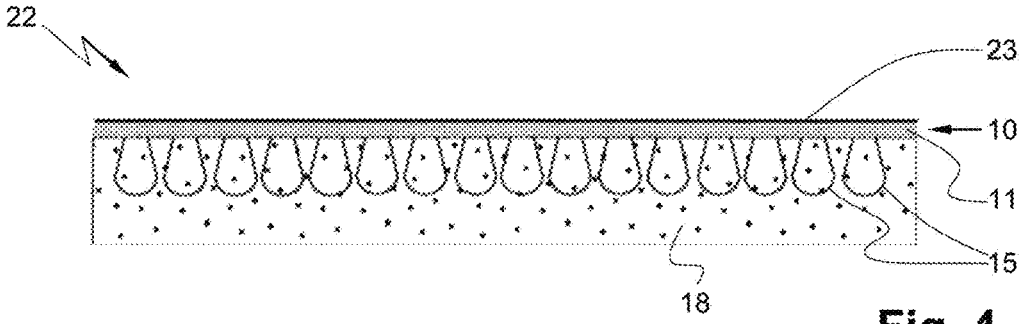
FIG. 4 illustrates a sealing tape with adhesive.
Figure 5:
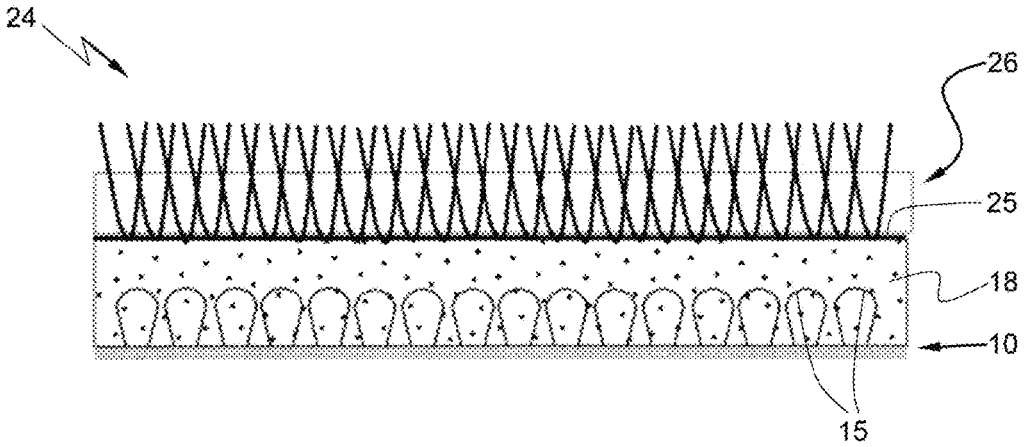
FIG. 5 illustrates a carpet.

FIGS. 3 through 5 illustrate exemplary embodiments in which a side of the warp knitted material 10 including the pile loops 15 is respectively encased by a foam material element 18 through injection molding.

FIG. 3 illustrates a sectional view of a rotation element 19 of a non illustrated grinding machine which is configured as a foam material element 18. It is evident that the pile loops 15 are embedded in the foam material element 18 and that the base structure 11 is arranged at the surface of the foam material element. A hook side 21 of a hook and loop closure is attached to the base structure 11 with a glue layer 20. Since the surface of the foam material element 18 is covered by the base structure 11 a substantially improved connection between the rotating element 19 and the hook side 21 is achieved.

FIG. 4 illustrates another embodiment configured as a sealing tape 22 with adhesive. Therein the foam material element 18 is in turn connected with the warp knitted material 10 so that the pile loops 15 are enveloped by the foam material element. A glue layer 20 is arranged on the base structure 11, wherein the glue layer has an excellent connection with the foam material element due to the textile structure of the surface of the foam material element.

Eventually FIG. 5 illustrates a sectional view through a carpet 24 in which a foam material element 18 is arranged at the base side in which the warp knitted material 10 is in turn embedded through the pole loops 15 so that the base structure stabilizes the downward oriented surface of the foam material element 18. Furthermore a glue layer 25 is arranged on the top side of the foam material element 18, wherein a pile 26 of the carpet is attached at the glue layer. Also herein it is conceivable that the surface is provided with a warp knitted material 10 in order to better attach the glue layer 25.

It is appreciated that the warp knitted contexture is useable in plastic injection molding as long as a melting point of the threads of the warp knitted material 10 is higher than a melting point of the material of the plastic element. In this case the warp knitted contexture can be used for providing a textile appearance to a surface of the plastic element or to provide in this case better adhesion of a glue layer at the plastic element.

REFERENCE NUMERALS AND DESIGNATIONS

10 warp knitted material
11 base structure
12 base thread
13 tassel thread
14 pile loop thread
15 pile loop
16 arm
17 stitch wale
18 foam material element
19 foam material rotation element
20 glue layer
21 hook side of hook and loop closure
22 sealing tape
23 glue layer
24 carpet
25 glue layer
26 pile
H height of pile loops 15
A distance between stitch wales 17

What is claimed is:

1. A warp knitted contexture, comprising:
a base structure; and
pile loops anchored in the base structure,
wherein a plurality of independently standing pile loops is arranged at the base structure through unilaterally tied drop stitch,
wherein a height of the pile loops is greater than a distance between stitch wales,
wherein the pile loops are only arranged on a side of the warp knitted contexture,
wherein the pile loops are arranged upright, and
wherein the pile loops extend from the base structure at a uniform angle.

2. The warp knitted contexture according to claim 1, wherein the base structure is formed from non elastic yarn or includes a non elastic stitch.

3. The warp knitted contexture according to claim 1,
wherein the warp knitted material has 14 to 40 stitch courses per centimeter and between 5.5 and 8.6 stitch wales per centimeter.

4. The warp knitted contexture according to claim 1, wherein the warp knitted material has 30 stitch courses per centimeter and 7 stitch wales per centimeter.

5. The warp knitted contexture according to claim 1, wherein the warp knitted material is formed from a multi-filament yarn.

6. The warp knitted contexture according to claim 1, wherein the warp knitted material includes a yarn with a dtex of 50 to 100.

7. The warp knitted contexture according to claim 1, wherein the warp knitted material has a dtex of 76.

8. The warp knitted contexture according to claim 1, wherein the warp knitted material has a dtex of 40-67 for attaching grinding discs.

9. The warp knitted contexture according to claim 1, wherein the warp knitted material has a dtex of 50 for attaching grinding discs.

10. A method of using a warp knitted contexture comprising:

providing a warp knitted contexture, the warp knitted contexture including:

a base structure; and pile loops anchored in the base structure, wherein a plurality of independently standing pile loops is arranged at the base structure through unilaterally tied drop stitch, wherein a height of the pile loops is greater than a distance between stitch wales, wherein the pile loops are only arranged on a side of the warp knitted contexture, wherein the pile loops are arranged upright, and wherein the pile loops extend from the base structure at a uniform angle; and stabilizing a surface of a foam material element or providing a surface for receiving a glue layer.

11. A method of using a warp knitted contexture comprising:

providing a warp knitted contexture, the warp knitted contexture including:

a base structure; and pile loops anchored in the base structure, wherein a plurality of independently standing pile loops is arranged at the base structure through unilaterally tied drop stitch, wherein a height of the pile loops is greater than a distance between stitch wales, and wherein the pile loops are only arranged on a side of the warp knitted contexture, wherein the pile loops are arranged upright, and wherein the pile loops extend from the base structure at a uniform angle; and providing a textile surface for a plastic element or providing a surface for receiving a glue layer.

12. A method of using a warp knitted contexture according to claim 10, stabilizing a surface of a foam material element and providing a surface for receiving a glue layer.

13. A method of using a warp knitted contexture according to claim 11, providing a textile surface for a plastic element and providing a surface for receiving a glue layer.

14. The warp knitted contexture according to claim 1, wherein the uniform angle is a right angle.

15. The method of using a warp knitted contexture according to claim 10, wherein the uniform angle is a right angle.

16. The method of using a warp knitted contexture according to claim 11, wherein the uniform angle is a right angle.

17. The warp knitted contexture according to claim 1, wherein the pile loops are arranged upright without any velourization.

18. A method of using a warp knitted contexture according to claim 10, wherein the pile loops are arranged upright without any velourization.

19. A method of using a warp knitted contexture according to claim 11, wherein the pile loops are arranged upright without any velourization.

* * * * *